United States Patent [19]

Xenidis

[11] Patent Number: 5,046,393

[45] Date of Patent: Sep. 10, 1991

[54] TREMOLO ARM AND ATTACHMENT MEANS FOR AN ELECTRIC GUITAR

[76] Inventor: Phil Xenidis, 1760 Grosvenor Place, Mississauga, Canada, L5L 3V8

[21] Appl. No.: 508,163

[22] Filed: Apr. 12, 1990

[51] Int. Cl.[5] ..... G10D 3/00

[52] U.S. Cl. ..... 84/313

[58] Field of Search ..... 84/313

[56] References Cited

U.S. PATENT DOCUMENTS

| | | | |
|---|---|---|---|
| 2,741,146 | 4/1956 | Fender | 84/313 X |
| 4,656,915 | 4/1987 | Osuga | 84/313 |
| 4,796,505 | 1/1989 | Takeuchi | 84/313 |
| 4,852,448 | 8/1989 | Hennessey | 84/313 |

*Primary Examiner*—Lawrence R. Franklin

[57] ABSTRACT

An improved tremolo arm and coupling means for an electric guitar is disclosed. Unlike conventional tremolo arms which extend generally parallel to the guitar in use, the tremolo arm according to the invention is mounted substantially perpendicularly to the plane of the guitar and incorporates several bends along its length which improve its ease of use. The tremolo arm is provided with coupling means adapted for use with standard anchoring means on an existing guitar to permit ready installation of the tremolo arm at a preselected angular disposition with respect to the guitar strings that avoids interference with the picking hand of the guitar player.

12 Claims, 3 Drawing Sheets

TREMOLO ARM AND ATTACHMENT MEANS FOR AN ELECTRIC GUITAR

The present invention relates to an improved tremolo arm including coupling means adapted for mounting the arm on a conventional tremolo unit for vibrato performance in an electric guitar, and more specifically to a tremolo arm which in use extends at an angle generally perpendicular to the plane of the guitar.

One of the earliest sound effect devices available to electric guitarists was the tremolo bridge system. Unique characteristics of "bending" the pitch of a note played has enabled guitarists to derive a greater degree of expression and emotion from their instruments than was theretofore possible.

Over the years, a number of refinements have been made to such systems, but one feature common to them all is the disposition of the actuating tremolo arm operated by the guitarist generally horizontally to the body of the guitar. An example of such an arrangement may be seen in U.S. Pat. No. 4,796,505, issued Jan. 10, 1989 to Takeuchi.

In conventional tremolo systems, the guitarist strums or plucks the strings then actuates the vibrato effect by manually oscillating the tremolo arm of the tremolo mechanism toward and away from the body of the guitar. This arrangement presents a number of performance difficulties and limitations which are inherent to the horizontal extension of the tremolo arm.

Conventional horizontally-extending tremolo arms, when firmly mounted to the tremolo mechanism of an electric guitar can interfere with the picking action by striking against the guitarist's hand, wrist, or lower arm during playing. Positioning and fixing the tremolo arm or bar in a desired position to minimize such interference was also often a difficult procedure. On the other hand, mounting the conventional tremolo arm loosely to the bridge so that it tends to swing downwardly away from the playing hand, while for the most part avoiding such interference, does so at the cost of having the tremolo arm positioned at an intermediate angle to the neck of the guitar, which may make its immediate and "instinctive" accessibility a problem.

With a view to overcoming the aforesaid disadvantages of conventional tremolo arms, the novel tremolo arm according to my invention is in use mounted substantially perpendicularly to the plane of the guitar, keeping it in a fixed easy to reach position that does not interfere with the picking hand when the arm is not in use.

The tremolo arm according to my invention preferably incorporates several bends along its length, which are designed to improve its ease of use by simplifying the location and grasping of the arm as compared to conventional tremolo arms, reducing the amount of actuating force required to produce a tremolo effect, and permitting the user, if desired, to operate the tremolo system in a "hands-off" mode with his knee, thereby permitting him to continue picking the strings of the guitar with his free hand. The positioning and shaping of the tremolo arm according to the invention, by contrast with conventional devices, does not interfere with the player's picking hand.

Moreover, the tremolo arm of the invention is adapted for use with anchoring means to permit its ready installation into the existing anchor of a conventional tremolo bridge for an electric guitar. The present invention can be easily installed and used with the Floyd-Rose tremolo system and other tremolo systems utilizing similar tremolo arm mounting assemblies.

A more complete understanding of the invention may be had with reference to the following description and accompanying drawings, in which.

Figure 1:
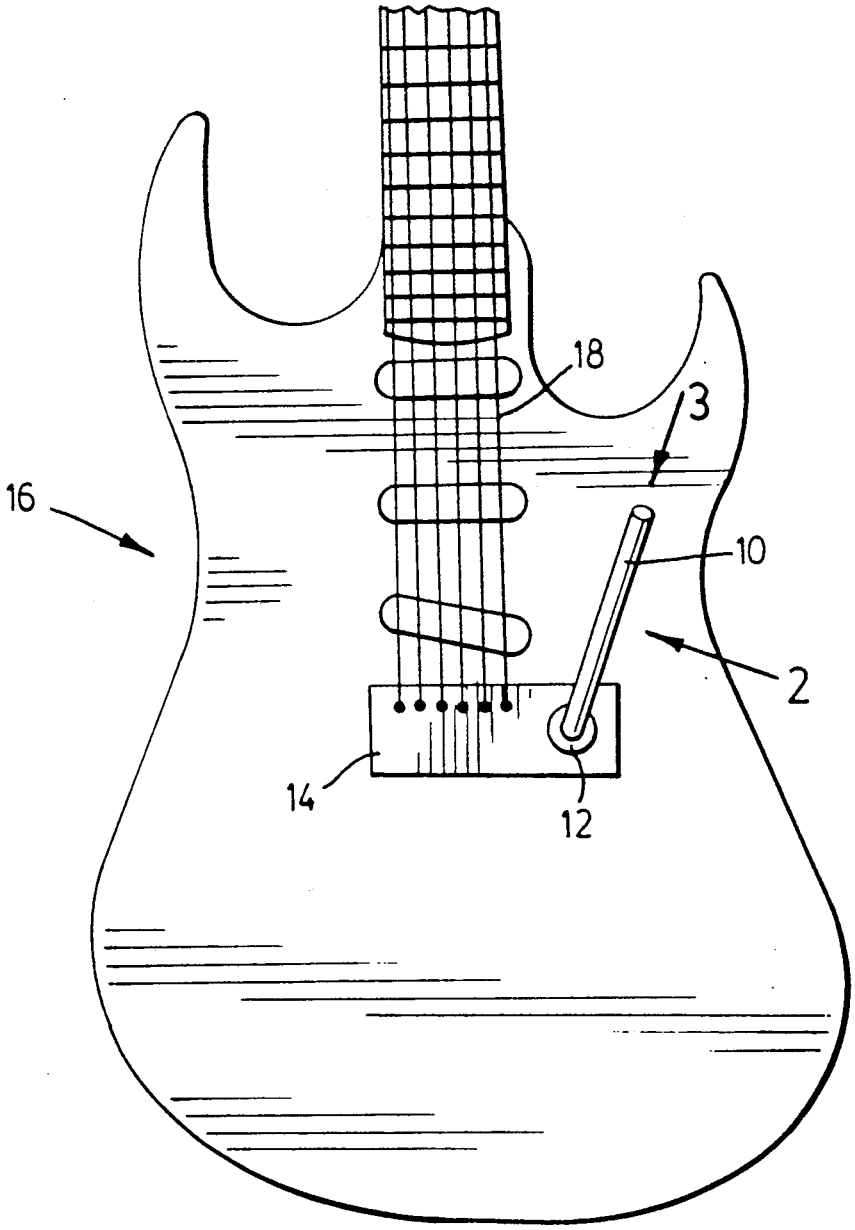
FIG. 1 is a partial schematic view in plan of a tremolo bar according to the invention attached to the tremolo bridge unit of a guitar.

FIG. 1 shows a tremolo arm according to the invention, consisting of a tremolo bar 10 attached by coupling means 12 to the bridge 14 of a Floyd-Rose system, or any other tremolo system using similar tremolo arm mounting assemblies on an electric guitar 16.

As discussed further below in connection with FIGS. 2 and 4, coupling 12 is designed to lock the tremolo bar 10 in a selected angular position of the player's preference in the horizontal plane (i.e. a plane generally parallel to the bridge and the guitar face). Ordinary performance techniques require that the tremolo arm be angularly positioned anywhere below (i.e. clockwise) to the high E string 18, in a position that does not interfere with the picking of the strings. Guitar 16 of FIG. 1 would be worn by a right-handed player with the high E string 18 at the bottom.

Apart from the requirement that the tremolo bar be angularly positioned within the horizontal plane so as not to interfere, the particular choice of angular setting will vary with the player's own preference and style. Thus, the angle might be set at 180° clockwise to the high E string (i.e. parallel with and oppositely directed to the strings), if it is intended that the tremolo arm will mostly be oscillated between a lifted and rest position rather than depressed Such will be the case when what is desired is a "bending" of the natural tones which is tonally upward for the most part.

This facility to affix tremolo bar 10 outside the picking or strumming range of the picking hand represents an improvement over conventional tremolo arms, which require a strumming adjustment by the picking hand for some musical styles to avoid striking the arm. As discussed below, the coupling 12 can remain attached to the standard bridge anchor and tightened down with tremelo arm 10 held at the selected position, enabling the tremolo arm to be easily demounted and reinstalled at the particular angular position preferred by the guitarist, thereby enhancing his performance abilities.

Figure 2:
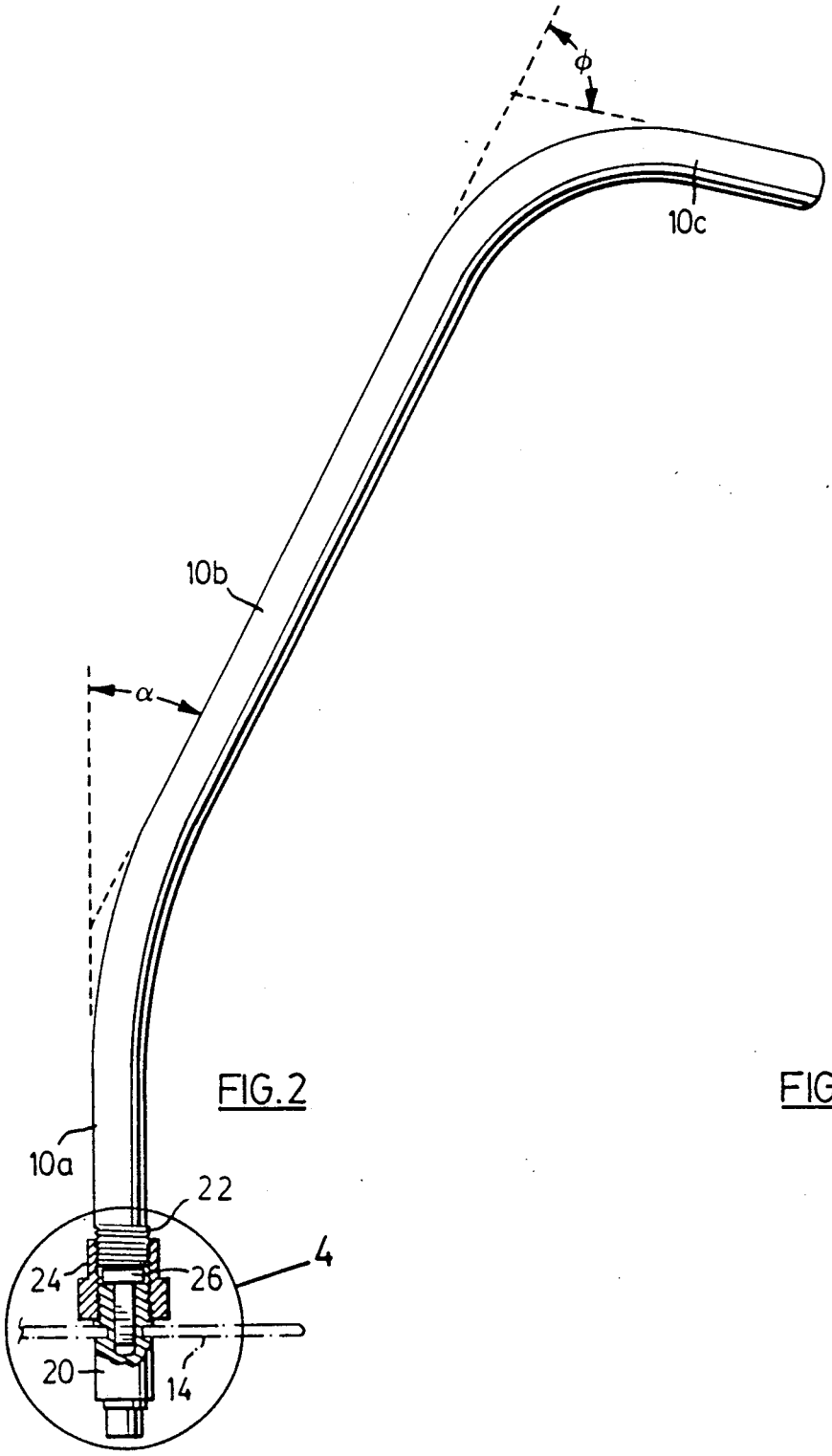
FIG. 2 is a view, partly in section in the circled region indicated by the numeral 4, of the tremolo arm and attachment means according to the invention, as viewed generally in the direction 2 of FIG. 1.
Figure 3:
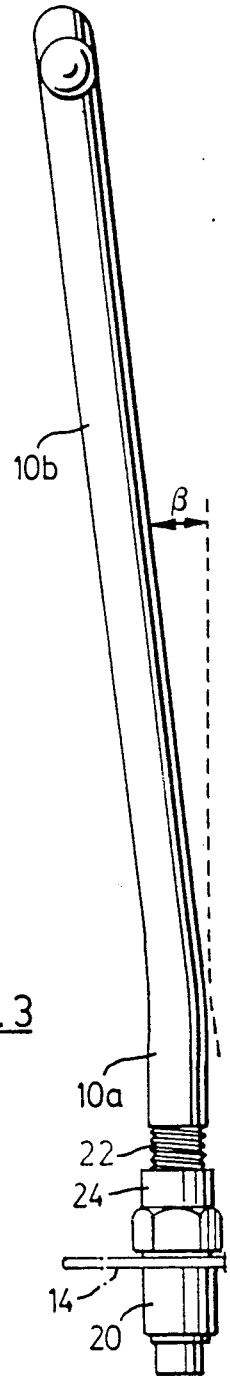
FIG. 3 is a view of the tremolo arm and attachment means of the invention, seen generally in the direction 3 in FIG. 1, but with the tremolo bar shown unscrewed from the coupling means.

As best seen in FIGS. 2 and 3, the tremolo bar 10 of the tremolo arm according to the invention comprises a first linear connecting portion 10*a* and a longer second linear portion 10*b* integral therewith. In the preferred embodiment, tremolo bar 10 is a solid bent rod of aluminum or other strong and lightweight metal.

The second portion 10*b* is inclined to the axis of the first portion 10*a*, which extends substantially perpendicularly to bridge 14, at an acute angle $\alpha$ of between about 0° and about 45°, so that in use tremolo bar 10 extends substantially perpendicularly away from the face of the guitar, unlike conventional tremolo arms which extend generally horizontally.

This arrangement presents a number of advantages over conventional tremolo arms. The outwardly extending tremolo bar 10 is in a more favourable position to receive the picking hand after picking or strumming the guitar strings.

Specifically, by being generally perpendicular to the plane of the guitar, the tremolo arm according to the present invention improves the guitarist's ability to produce the necessary actuating force for the tremolo effect by allowing more arm and shoulder-generated force to be used in oscillating the tremolo bar. With conventional, generally horizontal tremolo arms, the guitarist is restricted for the most part to wrist action to produce the tremolo effect.

I have found that an angle of bend $\alpha$ between the first and second portions, 10*a* and 10*b*, of around 27° is particularly advantageous in using the guitar for some styles of music, notably rock music, in that the guitarist can activate the tremolo arm with his knee, thereby freeing the picking hand. Too, the guitarist can grasp a generally perpendicular tremolo arm by his picking hand to produce any of a number of impressive theatrical effects with the guitar, while on stage.

I have also found that the efficiency and ease of use of the outwardly-extending tremolo arm 10 is enhanced if the second portion of the tremolo bar 10*b* is additionally inclined to the first portion 10*a* at a small angle $\beta$ in the plane orthogonal to the plane of angle $\alpha$ in FIG. 2, i.e. in a direction away from the strings of the guitar. This angle $\beta$, which is preferably around 6°, is best seen in the view of FIG. 3, taken in a direction at right angles to the view of FIG. 2.

Figure 4:
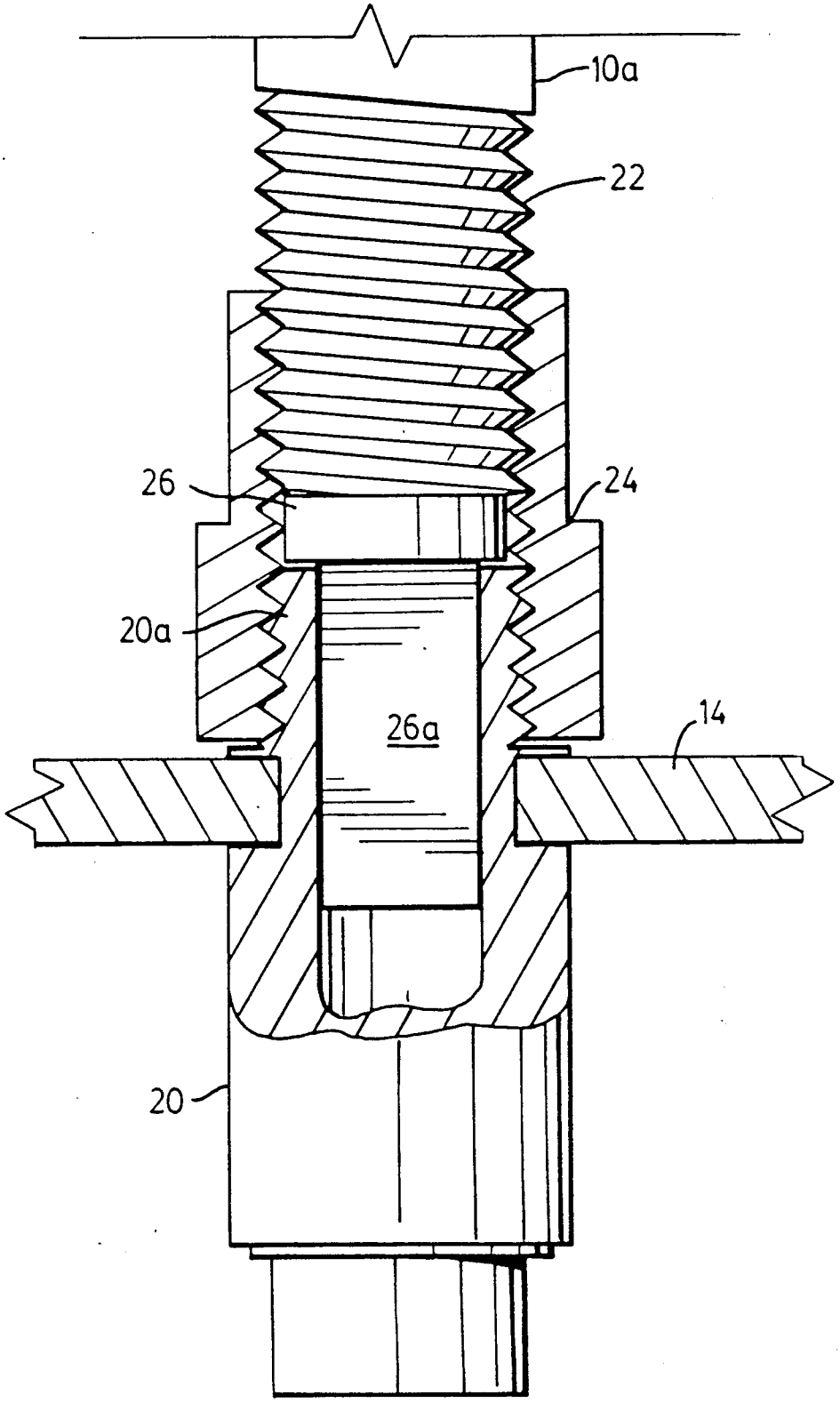
FIG. 4 is an expanded view of the sectional portion 4 of FIG. 1, showing in greater detail the coupling means connecting a tremolo bar according to the invention, in use, to the tremolo bridge fitting on an electric guitar.

The attachment means for the demountable tremolo arm according to my invention is best seen in FIGS. 2 and 4. The widely-used Floyd-Rose type of tremolo bridge system is provided with an anchor 20 including an upwardly extending threaded portion 20*a* projecting upwardly from tremolo bridge 14. According to my invention, there is provided a coupling means for detachably connecting the first portion 10*a* of the bar to the anchored fitting of a standard tremolo bridge in such a manner that the second portion of the bar is readily set at the aforementioned selected clockwise angular disposition to the guitar strings.

On the typical tremolo bridge for which the preferred embodiment of coupling means according to my invention is adapted, the given anchor connection 20*a* is, typically, a tubular male fitting with a standard thread. The first portion of the bar 10*a* in the tremolo arm according to the invention is threaded along the bottom portion thereof at 22 in the reverse sense of anchor connection 20*a*. There is provided a coupling sleeve 24 having a lower internal threaded portion 24*a* which permits sleeve 24 to be screwed onto anchor 20 to a stop-lock position with the bottom of sleeve 24 adjacent tremolo bridge unit 14.

Sleeve 24 has an upper internal threaded portion adapted to receive the threaded portion 22 of tremolo bar 10. In use, sleeve 24 may be left threaded partway onto the anchor and then tightened down by a wrench after the tremolo bar is screwed into the upper portion at sleeve 24 and while the tremolo bar is held at the desired horizontal angular disposition, thereby pulling together the two male fittings and connecting the tremolo bar to the bridge.

Preferably, the connecting means includes in addition to the sleeve 24 a rigidifying support peg 26 integral with the bottom of threaded portion 22 of tremolo bar 10 and having a lower portion 26*a* which is configured and dimensioned to be inserted into and to rest closely within the hollow interior of the standard tubular male fitting 20*a*.

The insertion of rigidifying member 26 into the fitting cavity before coupling the bar thereto with sleeve 24 imparts additional flexional strength to the connection to withstand the repeated and substantial bending forces exerted on that region when the tremolo bar is manually actuated in use.

Advantageously, the tremolo bar according to the invention may further include an uppermost third portion 10*c* to provide a convenient manual grip. As best seen in FIG. 2, portion 10*c* preferably extends horizontally to the face of the guitar or angled slightly downwardly towards the face of the guitar This facilitates actuating the tremolo bar by means of the player's knee when moved against the concave recess between portions 10*b* and 10*c*, and also facilitates manual operation of the tremolo arm to allow for additional theatrical effects such as actually swinging the guitar in the air while gripping tremolo bar 10 by handle 10*c*.

The downward angle of inclination between upper portion 10*c* and middle portion 10*b* of the tremolo bar, indicated in FIG. 2 as angle $\phi$ is selected to give the desired orientation of handle 10*c* relative to the plane of the guitar itself. For an angle $\alpha$ of about 27°, corresponding to the bar as shown in FIG. 2, a bend between portions 10*b* and 10*c* giving an angle $\phi$ of about 76° has been found to be convenient and effective.

In a preferred embodiment particularly adapted for use with an existing guitar having a Floyd-Rose tremolo system, tremolo bar 10 is made of bent aircraft aluminum rod $\frac{3}{8}$" in diameter, allowing for a lightweight and yet sturdy tremolo arm.

I claim:

1. A demountable and adjustable tremolo arm for an electric guitar with a tremolo bridge unit having an anchor or attachment of a tremolo arm thereto, comprising:

(a) a bar having a first linear portion for connection at the bottom end thereof to said anchor to extend outwardly from said bridge unit and a second linear portion integral with the top end of said first linear portion and inclined at an acute angle between 0° and about 45° to the axis thereof, so that in use said bar extends substantially away from the face of the guitar; and (b) coupling means for detachably connecting said first portion of the bar to said anchored fitting with the second portion of the bar set at a selected clockwise angular disposition to the guitar strings in a plane parallel to the face of the guitar.

2. A tremolo arm as defined in claim 1, wherein said anchor of the tremolo bridge unit comprises a tubular male fitting with a standard thread, said bar is externally threaded at the bottom of the first portion thereof reversely to said male fitting of the anchor, and said coupling means comprises a sleeve which is internally threaded at the lower end thereof for screwing the sleeve onto the anchor to a stopping position and is internally threaded at the upper end thereof for screwing the bar at its threaded end into said sleeve, so that with said bar screwed into said sleeve said sleeve may be tightly screwed onto said male fitting of the anchor with said second portion of the bar held at said selected clockwise angular disposition with respect to the guitar strings.

3. A tremolo arm as defined in claim 2, in which said coupling means further comprises a rigidifying support peg extending from the lower end of said first linear portion of the bar said peg being configured and dimensioned to be inserted into and to rest closely within the interior of said tubular male fitting of the tremolo bridge unit anchor to increase the flexional strength of coupling between the bar and the anchor when same are connected by said threaded sleeve.

4. A tremolo arm as defined in claim 3, wherein said first and second linear portions of the bar are smoothly joined along an arcuately curved bend in the bar.

5. A tremolo arm as defined in claim 4, wherein said second linear portion of the bar is angularly offset by a second acute angle in a plane orthogonal to said first acute angle, in a direction away from the strings of the guitar.

6. A tremolo arm as defined in claim 5, wherein said second acute angle is about 6°.

7. A tremolo arm as defined in claim 3, wherein said bar is fabricated of solid aluminum rod.

8. A tremolo arm as defined in claim 3, wherein said bar further comprises a linear third portion for gripping the bar and manually actuating same, said third linear portion being integrally connected with the top bend of the said second linear portion along a smooth bend, and so inclined relative thereto that said third gripping portion is substantially parallel to or inclined slightly toward the plane of the guitar.

9. A kit for installing a demountable and adjustable tremolo arm to a Floyd-Rose type electric guitar tremolo bridge unit having a tubular male fitting with a standard right-hand external thread for attachment of a tremolo arm thereto, comprising:

(a) a tremolo bar having a short first linear lower connecting portion with an external left-handed male thread and an elongate second linear portion, integral with the top end of said first linear portion, said bar being bent between adjacent said portions thereof such that when said lower connecting portion is connected to said fitting of the said tremolo bridge unit, said lower connecting portion extends perpendicularly to the face of the guitar and said middle portion is inclined downwardly toward the face of the guitar at a first acute angle to said connecting portion and is angularly offset orthogonally to said first acute angle by a second acute angle in a clockwise direction to the strings of the guitar; and (b) coupling means comprising a sleeve internally threaded at the lower end thereof for screwing said sleeve onto said anchor to a stopping position and internally threaded at the upper end thereof for screwing the threaded end of said tremolo bar into the upper end of said sleeve, so that with said bar screwed into said sleeve said sleeve may be tightened onto said male fitting of the anchor with the second linear portion thereof held at a selected angular disposition with respect to the strings of the guitar.

10. A kit according to claim 9, wherein said coupling means further comprises a rigidifying support peg extending from the lower end of said first linear portion, of the bar, said peg being configured and dimensioned to be inserted into and to rest closely within the interior said tubular male fitting of the tremolo bridge unit anchor to increase the flexional strength of coupling between the bar and the anchor when same are connected by said threaded sleeve.

11. A kit according to claim 9, wherein said first acute angle is about 27°.

12. A kit according to claim 9 or claim 10, wherein said second acute angle is about 6°.

* * * * *